US005555980A

United States Patent [19]

Johnston et al.

[11] Patent Number: 5,555,980

[45] Date of Patent: Sep. 17, 1996

[54] COLLAPSIBLE PALLETIZED CONTAINER

[75] Inventors: James B. Johnston, Loomis; James S. Tyler, Gridley; Guy C. Blanchard, Sacramento, all of Calif.

[73] Assignee: Johnson's Trading Post, Inc., Woodland, Calif.

[21] Appl. No.: 311,103

[22] Filed: Sep. 23, 1994

[51] Int. Cl.[6] ..... B65D 19/00

[52] U.S. Cl. ..... 206/600; 206/386; 220/4.28

[58] Field of Search ..... 206/600, 386; 220/4.28, 4.30; 217/12 R, 13, 43 R, 45

[56] References Cited

U.S. PATENT DOCUMENTS

| | | | |
|---|---|---|---|
| 279,199 | 6/1883 | Stevens . | |
| 1,940,309 | 12/1933 | Lackey | 229/49 |
| 2,260,424 | 10/1941 | Waters | 206/65 |
| 2,349,364 | 5/1944 | Marshall, Jr. | 229/15 |
| 2,534,010 | 12/1950 | Frye | 229/23 |
| 2,534,011 | 12/1950 | Frye | 229/23 |
| 2,683,010 | 7/1954 | Hamerslag, Jr. | 248/120 |
| 2,700,521 | 1/1955 | Lapham | 248/120 |
| 2,713,962 | 7/1955 | Camp et al. | 229/31 |
| 3,176,898 | 4/1965 | Seger, Jr. | 229/6 |
| 3,540,613 | 11/1970 | Hudson, Jr. | 217/12 R |
| 3,563,403 | 2/1971 | Luisada | 220/4.28 |
| 3,989,156 | 11/1976 | Lowry | 217/12 R |
| 4,054,223 | 10/1977 | Marques | 220/4 |
| 4,221,296 | 9/1980 | Fell et al. | 206/600 |
| 4,324,333 | 4/1982 | Porter | 206/526 |
| 4,426,015 | 1/1984 | Preston et al. | 220/403 |
| 4,454,946 | 6/1984 | Yokowo | 206/600 |
| 4,499,997 | 2/1985 | Swingley, Jr. | 206/509 |
| 4,516,692 | 5/1985 | Croley | 222/105 |
| 4,697,699 | 10/1987 | Schneider | 206/44.11 |
| 4,763,787 | 8/1988 | Koenig | 206/402 |
| 4,786,192 | 11/1988 | Graves et al. | 383/119 |
| 4,949,898 | 8/1990 | Nederveld | 229/117.02 |
| 5,036,979 | 8/1991 | Selz | 206/512 |
| 5,253,763 | 10/1993 | Kirkley et al. | 206/600 |
| 5,323,911 | 6/1994 | Johnston et al. | 206/600 |
| 5,381,915 | 1/1995 | Yardley | 206/600 |

FOREIGN PATENT DOCUMENTS

| | | | |
|---|---|---|---|
| 2651746 | 3/1991 | France | 206/600 |
| 500211 | 1/1956 | Italy | 220/4.28 |
| 842635 | 7/1960 | United Kingdom | 220/4.28 |
| 1066615 | 5/1967 | United Kingdom . | |

OTHER PUBLICATIONS

Contico International Material Handling Division, "The Ultimate", entire advertisement.

Stephen Moore, "Gas–Assist Injection is Taking On Tougher Challenges", *Modern Plastics,* Aug., 1994, pp. 52–54, 56.

Beatrice/Hunt–Wesson, "An Introduction to Beatrice/Hunt–Wesson Bag–in–Bin Tomato Paste", entire brochure.

American Plywood Association, "APA Industrial Use Guide—Slim Bin", Jan,. 1991, entire brochure.

*Primary Examiner*—Paul T. Sewell
*Assistant Examiner*—Marie Denise Patterson
*Attorney, Agent, or Firm*—Bernhard Kreten

[57] ABSTRACT

A collapsible palletized container is provided including a base with individual sidewalls extending upward therefrom and a lid. The base includes grooves thereon which receive tongues attached to lower edges of the sidewalls. The tongues are angled so that the sidewalls are pivoted into position adjacent the base. The tongues and grooves are configured to prevent vertical translation of the sidewalls away from the base. Each sidewall includes two side edges including joints thereon to hold adjacent sidewalls together thereby obviating the need for girding straps to resist forces exerted horizontally by loads within the container. The sidewalls include ribs to reinforce the sidewalls. The lid connects to the sidewalls with clips connected therebetween.

30 Claims, 10 Drawing Sheets

COLLAPSIBLE PALLETIZED CONTAINER

FIELD OF THE INVENTION

The following invention relates to collapsible storage containers having a palletized base for storage and transportation of liquids or other substances which exert hydrostatic lateral forces on the container. More particularly, this invention relates to collapsible palletized containers which can support substantial loads therein before requiring the support of straps girding an exterior thereof. The containers are configured to facilitate mass construction.

BACKGROUND OF THE INVENTION

Containers are commonly used in the storage and transportation of fluids, typically viscous liquids, such as tomato paste or other food products. The containers are palletized and have rigid walls and a lid. The containers define an interior which supports a bag filled with the fluid. Commonly these containers are collapsible for reuse so that they require less space for storage and transport when empty. The container must be strong enough when assembled to survive the rigors of transportation and still be easily stackable when collapsed to maximize warehouse space.

Standardized sizes of forklifts, tractor trailer rigs, railroad cars, and other shipping vehicles have resulted in the proliferation of containers which have a footprint similar to that of a standard 44-inch by 48-inch pallet and which have a height of approximately 30 to 50 inches. Containers which deviate significantly from these dimensions are less economical in that they do not fit as easily onto various transportation systems and are not as easily manipulated by commonly available handling means such as forklifts.

Containers of this type have commonly been made from plywood or other heavy and strong, yet increasingly expensive materials. The four walls of these cubic containers are held together by, inter alia, a combination of horizontal straps girding the walls and L-shaped brackets at corners between the walls which are attached to two of the four walls. The walls are held adjacent the base by straps which gird the walls, lid and pallet in vertical planes.

While these prior art containers can perform the requisite task of containing and supporting liquids during transport, they exhibit a number of drawbacks. Wood has a tendency to splinter and crack. Thus, joints cannot be formed within the wooden walls themselves as they are typically not sufficiently strong to withstand the hydrostatic forces exerted from within by the contained liquids. Thus, corner supports are added to the wooden walls and straps are utilized to gird and support the walls. These added accessories not only increase material cost to form the container but also require additional labor to assemble the container, thus increasing the total unit cost for the container. These accessories also add weight to the container, complexity and expense in handling the container. Additionally, cost and weight comparisons of container walls formed from wood versus alternative materials suggest that alternative materials may compete with wood in forming the container. Such materials could be formed from synthetic materials into strength optimizing geometries which are difficult to form in wood materials. As environmental concerns over the management of forests and forest products has increased, the use of wood products has become less desirable environmentally and economically.

Accordingly, a need exists for a container utilizeable in supporting fluids and other substances which exert hydrostatic force. Such a container is needed which can resist the hydrostatic forces exerted by substances within the container without the need for straps or accessories. Additionally, a container is needed which exhibits a geometry which can be readily formed from alternative materials, such as high strength recyclable plastics, so that a dependence on forest products is reduced or eliminated.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| | ISSUE DATE | INVENTOR |
|---|---|---|
| | U.S. PATENT DOCUMENTS | |
| U.S. PAT. NO. | | |
| 279,199 | June 12, 1883 | Stevens |
| 1,940,309 | December 19, 1933 | Lackey |
| 2,260,424 | October 28, 1941 | Waters |
| 2,349,364 | May 23, 1944 | Marshall, Jr. |
| 2,534,010 | December 12, 1950 | Frye |
| 2,534,011 | December 12, 1950 | Frye |
| 2,683,010 | July 6, 1954 | Hamerslag |
| 2,700,521 | January 25, 1955 | Lapham |
| 2,713,962 | July 26, 1955 | Camp, et al. |
| 3,176,898 | April 6, 1965 | Seger, Jr. |
| 4,054,223 | October 18, 1977 | Marques, et al. |
| 4,221,296 | September 9, 1980 | Fell, et al. |
| 4,324,333 | April 13, 1982 | Porter |
| 4,426,015 | January 17, 1984 | Preston, et al. |
| 4,454,946 | June 19, 1984 | Yokowo |
| 4,499,997 | February 19, 1985 | Swingley, Jr. |
| 4,516,692 | May 14, 1985 | Croley |
| 4,697,699 | October 6, 1987 | Schneider |
| 4,763,787 | August 16, 1988 | Koenig |
| 4,786,192 | November 22, 1988 | Graves, et al. |
| 4,949,898 | August 21, 1990 | Nederveld |
| 5,036,979 | August 6, 1991 | Selz |
| 5,323,911 | June 28, 1994 | Johnston, et al. |
| | FOREIGN PATENT DOCUMENTS | |
| DOCUMENT NO. | | |
| GB 1,066,615 | May 12, 1967 | Forster |

OTHER PRIOR ART

Contico International Material Handling Division, "The Ultimate", entire advertisement.

Moore, Stephen, "Gas-Assist Injection is Taking On Tougher Challenges", *Modern Plastics*, August, 1994, pages 52–54, 56.

Beatrice/Hunt-Wesson, "An Introduction to Beatrice/Hunt-Wesson Bag-in-Bin Tomato Paste", entire brochure.

American Plywood Association, "APA Industrial Use Guide—Slim Bin", January, 1991, entire brochure.

The brochure presented by Beatrice/Hunt-Wesson (undated) for the bag-in-bin container teaches the use of a collapsible palletized container which receives a bag filled with fluid (such as tomato paste) on an interior thereof. The instant invention is distinguishable from this reference in that it provides, inter alia, joints on walls thereof which connect each wall to adjacent walls and to the pallet so that the container can withstand hydrostatic forces exerted from within without girding straps or other reinforcements.

The patent to Preston teaches the use of a container which is palletized and resists hydrostatic forces without the use of girding straps. The container of the instant invention is distinguishable from Preston in that, inter alia, the walls themselves support the hydrostatic loads rather than reinforcing posts as in Preston and the individual walls are separable for convenient collapsibility.

The remainder of the prior art identified above, but not specifically distinguished from the present invention, diverge even more starkly from the present invention than do those inventions specifically distinguished above.

SUMMARY OF THE INVENTION

The collapsible palletized container of this invention includes four substantially planar rectangular sidewalls extending perpendicularly from a periphery of a base including a pallet thereunder. A planar rectangular lid is sized to rest upon upper edges of the sidewalls of the container. A periphery of a floor of the base includes grooves thereon for connecting to the sidewalls of the container. Each of the sidewalls includes a tongue on a lower edge thereof which is receivable within the grooves in the floor. The tongues slide into the grooves in a non-vertical direction, and, once within one of the grooves, each tongue is prevented from being displaced out of the groove vertically.

Each of the sidewalls include side edges which include joints thereon to connect to adjacent sidewalls. These joints prevent the sidewalls from being displaced outward away from an interior of the container. When loaded, the walls are prevented from moving toward an interior of the container by hydrostatic forces supplied by the contained material. Because the sidewalls are prevented from moving away from or toward an interior of the container when the container is loaded, and the tongue and groove joint connecting the sidewalls to the floor prevents vertical motion of the sidewalls, each of the sidewalls is held securely in place when the container is erected and loaded.

The lid is connectable to upper edges of the sidewalls to provide additional rigidity to the container. The base, sidewalls and lid can all be collapsed and stacked flat when the container is to be transported in an empty configuration.

OBJECTS OF THE INVENTION

Accordingly, it is a primary object of the present invention to provide a container for supporting hydrostatic force exerting materials therein which can resist the hydrostatic forces without girding straps or other accessories attached thereto and which is collapsible.

Another object of the present invention is to provide a container which includes a pallet integrally formed therein for ease of handling.

Another object of the present invention is to provide a container which includes four substantially planar rectangular sidewalls which include joints at edges thereof which connect the sidewalls to adjacent sidewalls.

Another object of the present invention is to provide a container which includes sidewalls supported upon a planar floor which connect to the floor in a manner preventing the sidewalls from translating vertically away from the floor.

Another further object of the present invention is to provide a container which is formed from low-cost injection moldable materials.

Another further object of the present invention is to provide a container which requires little labor in manufacturing and assembly.

Another further object of the present invention is to provide a container which is of durable, light weight construction.

Another object of the present invention is to provide a container which is formed from recycleable materials.

Another object of the present invention is to provide a container which resists creep in the materials so that the container can be reused numerous times.

Another object of the present invention is to provide a container which is configured to allow stacking vertically when loaded or unloaded, and which is shaped to nest with other containers laterally adjacent thereto in a space conserving arrangement.

Another object of the present invention is to provide a container for supporting items within an interior thereof during transport, storage and handling, comprised of a base including a substantially horizontal floor, at least two first sidewalls supported by said base and extending vertically above said base, each first sidewall including at least two side edges, at least two second sidewalls separate from said first sidewalls and supported by said base, said second sidewalls extending vertically above said base, each said second sidewall including at least two lateral edges, said side edges including means to prevent movement of said first sidewalls away from said interior integrally formed with said first sidewalls, and said lateral edges including means to prevent movement of said second sidewalls away from said interior integral with said second sidewalls, such that forces exerted by items stored within said interior are resisted by said first sidewall movement prevention means and said second sidewall movement prevention means.

Another object of the present invention is to provide an industrial platform for supporting objects thereon and facilitating handling thereof, comprised of a substantially horizontal floor having a top surface and a bottom surface, means to support said floor above a surface at a sufficient elevation to allow a pallet-lifting device to be located beneath said floor, said floor having edges defining a perimeter of said floor, a plurality of walls extending upwardly from said top surface, and means integral with said walls and said floor to removably secure said walls to said floor.

Another object of the present invention is to provide a method for erecting a collapsible palletized container from a base, two first walls, two second walls and a lid, including providing the base with four edges defining a periphery, the base having a means to removably connect to the walls adjacent to the edges, providing the walls with side edges, the side edges including means to couple two side edges of adjacent walls, connecting two similar walls to opposite sides of the base and extending up from the base, connecting a remaining two similar side walls to remaining opposite sides of the base and extending up from the base, and coupling the two first walls to the two second walls through the coupling means.

These and other objects will be made manifest when considering the following detailed specification when taken in conjunction with the appended drawing figures.

DESCRIPTION OF PREFERRED EMBODIMENTS

Figure 1:
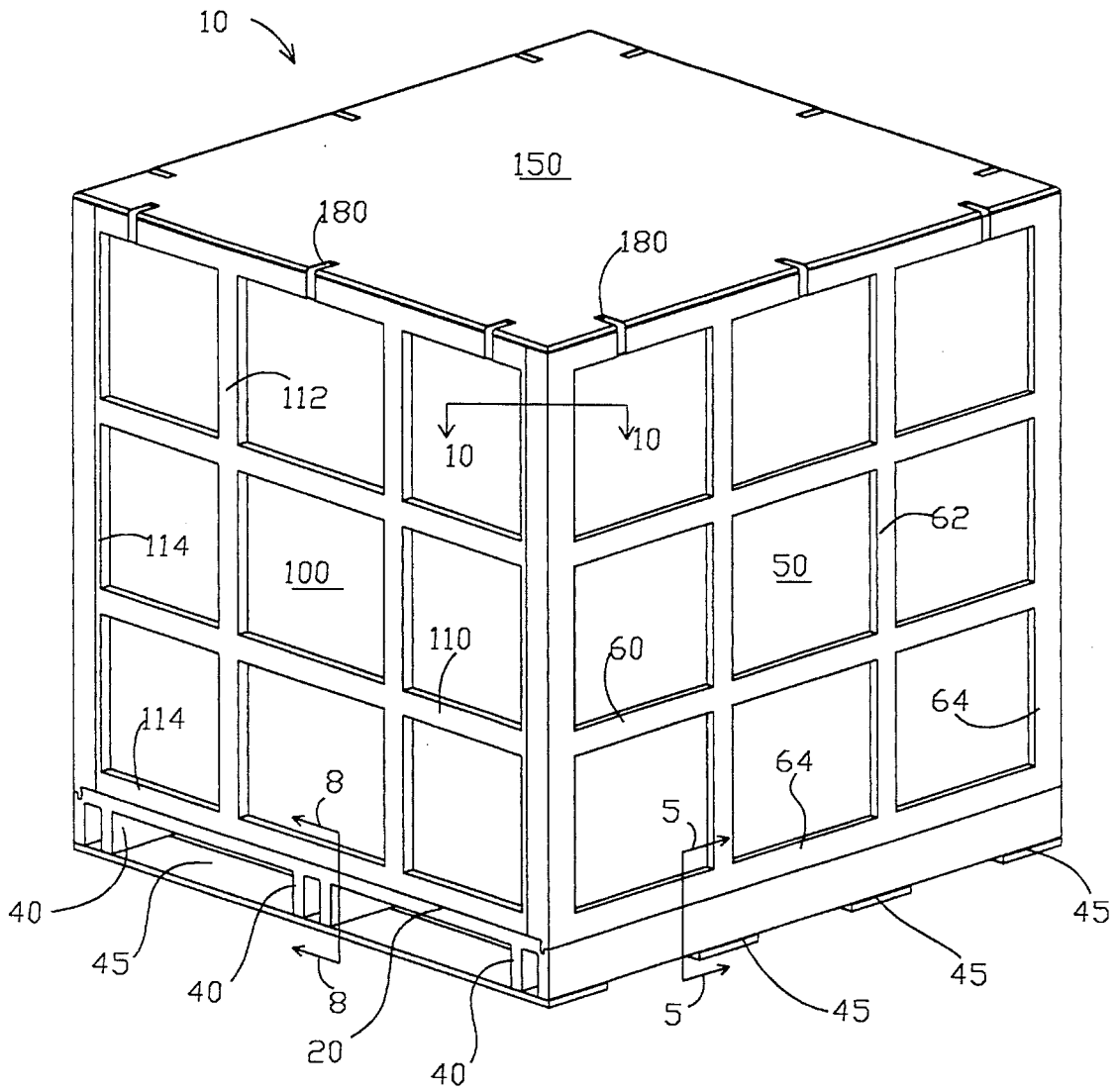
FIG. 1 is a perspective view of the container of this invention in assembled form.

With reference to the drawings, wherein like reference numerals denote like parts throughout, reference numeral 10 (FIG. 1) is directed to a collapsible palletized container. The container 10 rests upon a base 20. The container 10 includes first long sidewalls 50, second short sidewalls 100, and a lid 150 all supported upon the base 20.

Figure 2:
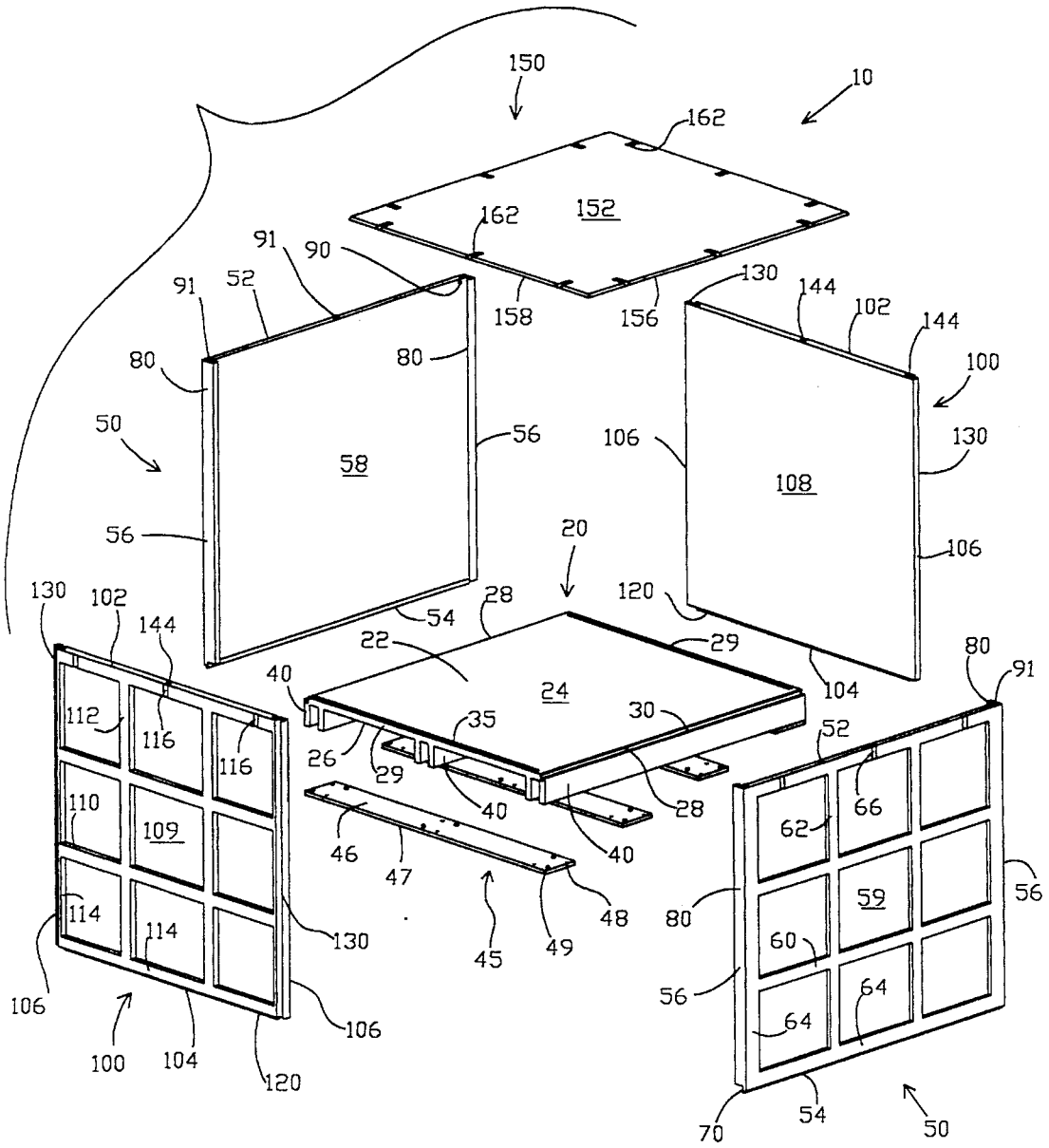
FIG. 2 is a perspective view of that which is shown in FIG. 1 with individual parts of the container exploded away from a base thereof.
Figure 3:
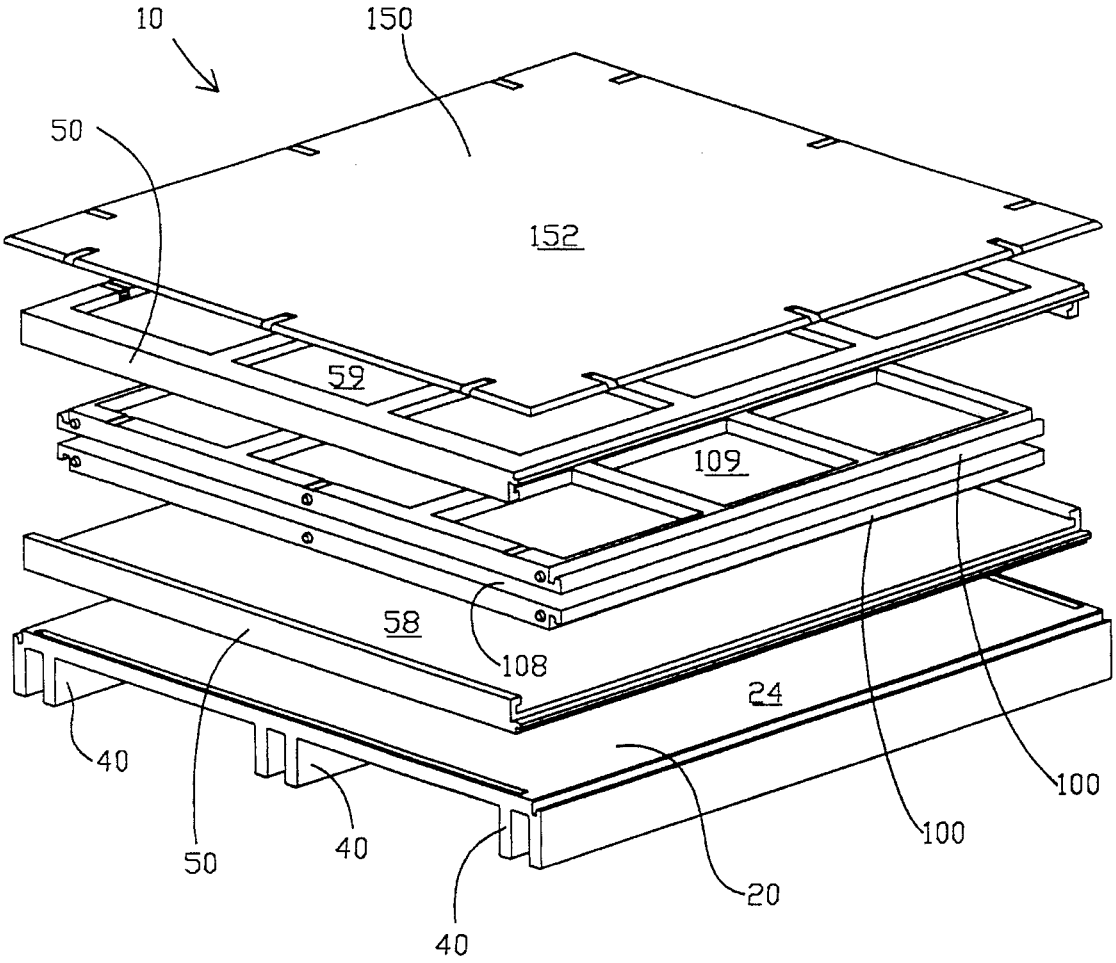
FIG. 3 is a perspective view of the various parts of that which is shown in FIG. 1 in a stacked arrangement for shipping when unloaded.

In essence, and with reference to FIGS. 1 and 2, the container 10 is generally described. The container 10 is supported above-ground by the base 20. The base 20 includes a floor 22 supported upon stringers 40 which themselves are supported upon boards 45. The base 20 thus exhibits a configuration similar to that of a standard industrial pallet. The two long sidewalls 50 are oriented parallel to each other and connect to long edges 28 of the floor 22. The long sidewalls 50 include a lower edge 54 with a tongue 70 extending downwardly therefrom. The tongue 70 is sized to fit within one of two long grooves 30 formed along the long edges 28 of the floor 22. The short sidewalls 100 include a low edge 104 which includes a tab 120 extending downward therefrom. The tab 120 is receivable within one of two short grooves 35 formed along short edges of the floor 22. The short edges 29 are oriented along edges of the floor 22 which do not include the long edges 28. Thus, the two long sidewalls 50 are oriented parallel to and opposite each other, and the two short sidewalls 100 are oriented parallel to each other and on opposite sides of the container 10.

The long sidewalls 50 include side edges 56 with J-joints 80 thereon. The short sidewalls 100 include lateral edges 106 with F-joints 130 thereon. The F-joints 130 are configured to interface with the J-joints 80, providing one form of a means to connect the long sidewalls 50 to the short sidewalls 100 so that neither the long sidewalls 50 nor the short sidewalls 100 can be displaced away from an interior of the container 10 when the J-joint 80 and F-joint 130 are connected together. The lid 150 is sized to overlie upper edges 52 of the long sidewalls 50, and the high edges 102 of the short sidewalls 100. A plurality of clips 180 are connected between the long edges 156 of the lid 150, and the long sidewalls 50 and between the short edges 158 of the lid 150, and the short sidewalls 100. The clips 180 connect the lid 150 securely to the sidewalls 50, 100.

More specifically, and with specific reference to FIGS. 1 through 8, details of the base 20 are described in detail. The base 20 is preferably a unitary mass upon which all other portions of the container 10 are supported. The base 20 includes the floor 22 which is substantially rectangular and of constant thickness between a top surface 24 and a bottom surface 26. Preferably, the floor 22 is only provided with sufficient thickness to support a weight of other portions of the container 10 and a load of items placed within the container 10, as well as additional containers 10 or other items which may be stacked upon the container 10. The floor 22 includes the two long edges 28 on opposite sides of the floor 22 and the two short edges 29 on opposite sides of the floor 22 and between the long edges 28.

The long edges 28 include a long groove 30 extending downward through the top surface 24 (FIG. 4) and extending entirely along the two long edges 28 of the floor 22. Each long groove 30 includes a first wall 31, a second wall 32 and a bottom wall 34 which is located between the first wall 31 and the second wall 32. The bottom wall 34 is preferably parallel to the top surface 24 of the floor 22. Preferably, the second wall 32 is shorter than the first wall 31 and a shelf 33 is provided extending from a top of the second wall 32 and away from the first wall 31.

The first wall 31 and second wall 32 are both preferably curved at different substantially constant radii of curvature. The first wall 31 preferably has a longer radius of curvature than the second wall 32. However, both the second wall 32 and first wall 31 preferably curve about a common axis so that the second wall 32 is essentially a constant distance from the first wall 31. For ease in manufacture, the first wall 31 and second wall 32 may be slightly closer together at the bottom wall 32 than they are adjacent the shelf 33 and the top surface 34 of the floor 22. This slight divergence of the first wall 31 and second wall 32 as they extend away from the bottom wall 34 also facilitates insertion of the tongue 70 of one of the long sidewalls 50 thereinto, as will be discussed in detail below.

The first wall 31 curves to overlie the bottom wall 34, thus providing one form of a means to prevent vertical and perpendicular movement of the tongue 70 and long sidewall 50 out of the long groove 30. When coupled with the pivot resisting action of the J-joints 80 and F-joints 130, this feature of the long grooves 30 provides a means to secure the long sidewalls 50 to the base 20.

Figure 4:
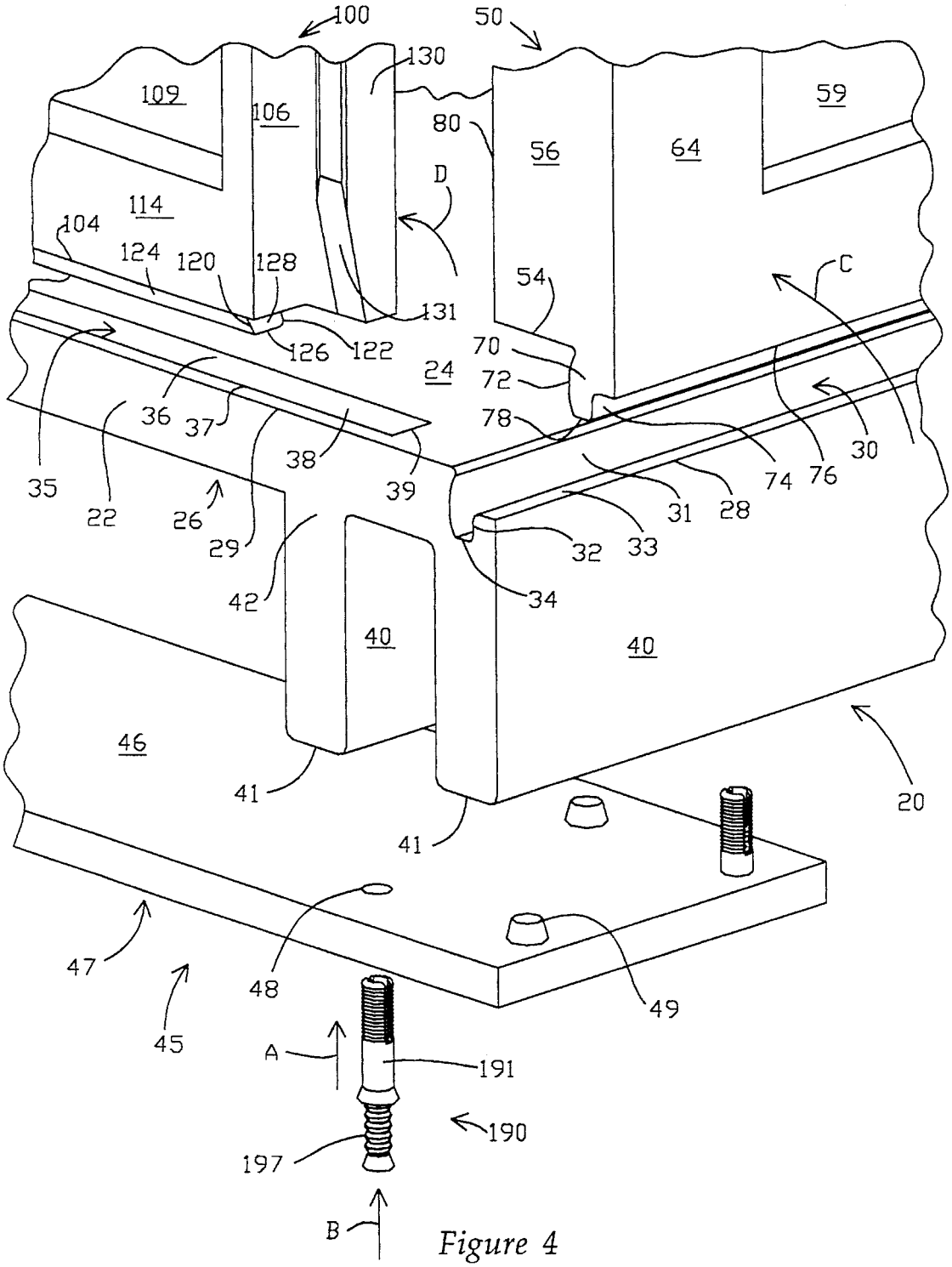
FIG. 4 is a perspective view of a corner of the base of this invention with adjacent parts exploded therefrom revealing details of how the various parts of the container are connected to the base.
Figure 6:
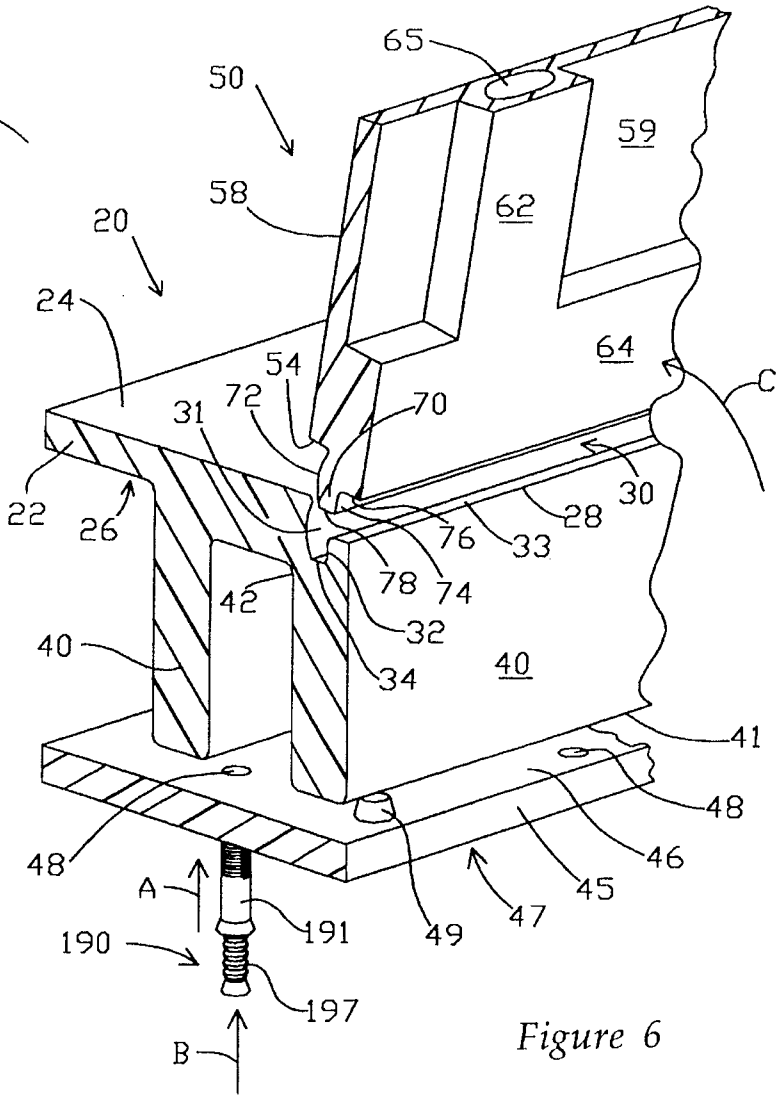
FIG. 6 is a perspective view of that which is shown in FIG. 5.
Figure 5:
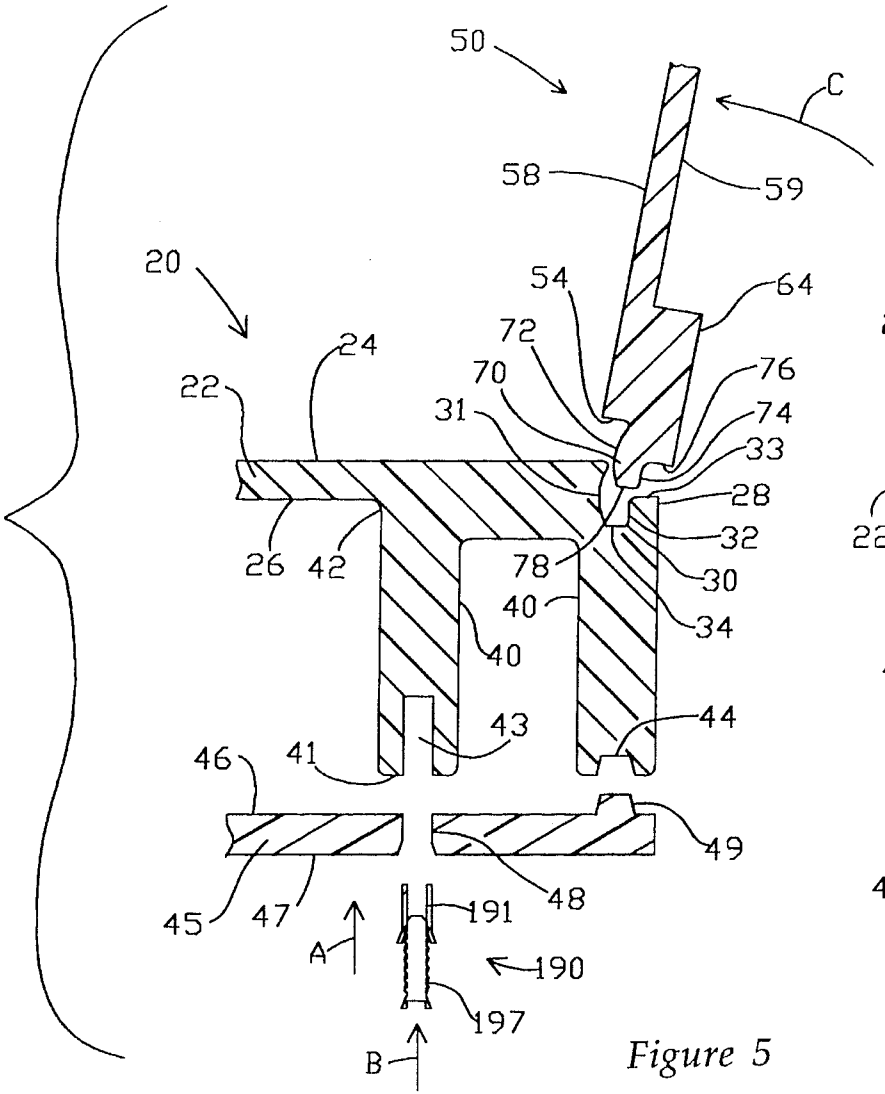
FIG. 5 is a sectional view taken along line 5—5 of FIG. 1 with separate parts exploded apart.
Figure 8:
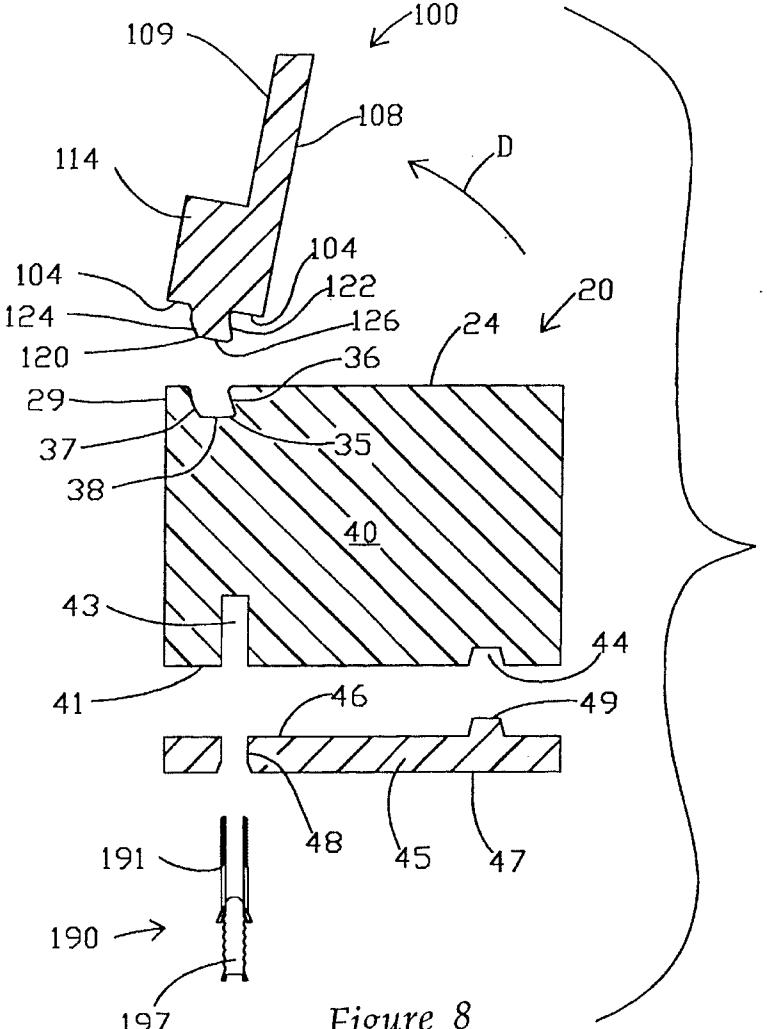
FIG. 8 is a sectional view taken along line 8—8 of FIG. 1 with separate parts exploded apart.
Figure 7:
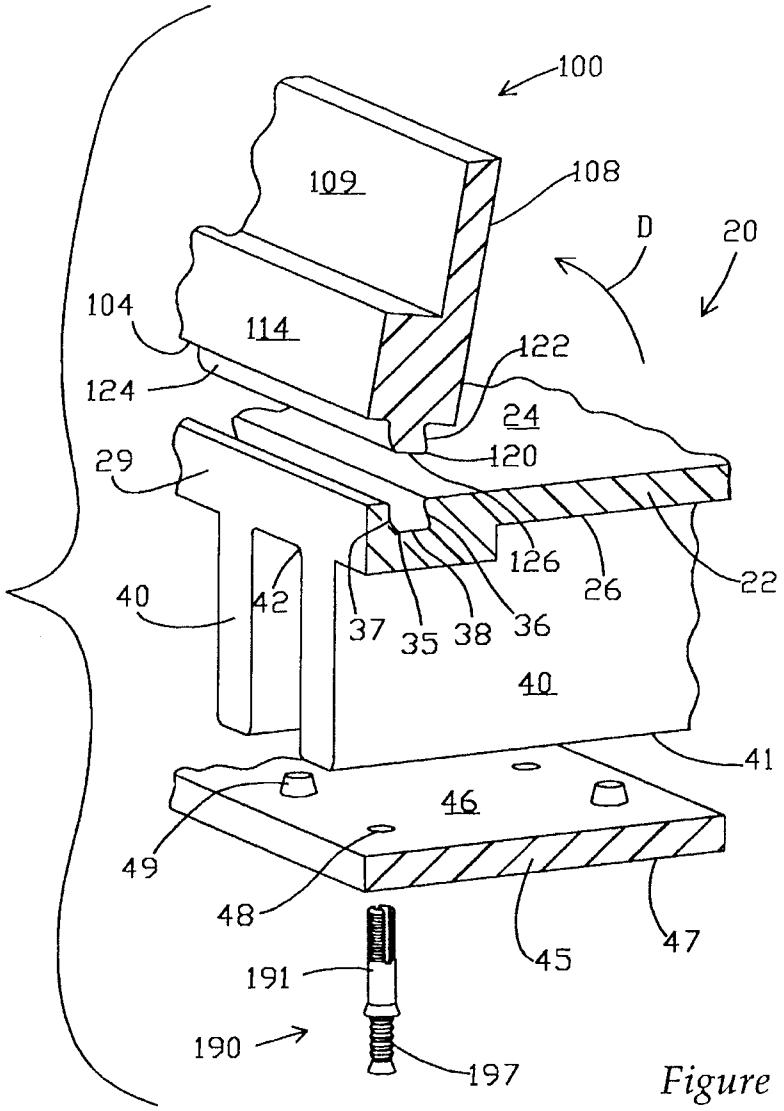
FIG. 7 is a perspective view of that which is shown in FIG. 8.

The short grooves 35 extending along the short edges 29 (FIGS. 7 and 8) include an inside wall 36 and an outside wall 37 extending down to a lower wall 38. The short groove 35 preferably includes end walls 39 which prevent the short groove 35 from extending to intersection with the long grooves 30 (FIG. 4). The lower wall 38 is preferably substantially parallel to the top surface 24 of the floor 22.

The inside wall 36 and outside wall 37 are preferably curved in a manner and to an extent similar to that exhibited by the long groove 30. However, the inside wall 36 and outside wall 37 curve about a common axis which is located on an interior side of the short groove 35. In contrast, the long edges 28 and short edges 29 of the long groove 30 are configured to curve about a common axis oriented along a side of the long groove 30 opposite an interior of the container 10. The orientation of the short groove 35 facilitates insertion of the tab 120 of one of the short sidewalls 100 thereinto as will be discussed in detail below. The inside wall 36 is configured to overlie the lower wall 38 to prevent short sidewall 100 vertical motion and to secure the sidewall 100 to the base 20 in a manner similar to the long groove 30.

The bottom surface 26 of the floor 22 is supported upon stringers 40. The stringers 40 are preferably planar elongate constructs integrally formed with the floor 22 and extending down from the floor 22 from a top edge 42 adjacent the bottom surface 26 to a bottom edge 41 below the top edge 42. Preferably, six stringers extend down from the bottom surface 26 in pairs with one pair extending below one of the long edges 28, another pair extending below the remaining long edge 28, and one pair parallel to the other pairs and oriented at a medial location therebetween. Thus, two large gaps are presented between the stringers 40 which allow lifting devices such as the forks of a forklift to easily slide under the bottom surface 26 and lift the container 10 for movement. Each of the stringers 40 is preferably oriented substantially parallel to the other stringers 40.

Boards 45 of substantially thin elongate construction are oriented below the bottom edges 41 of the stringers 40 in an orientation with a long axis of the boards 45 substantially perpendicular to a long axis of the stringers 40. The boards 45 include a top 46 and a bottom 47. The boards 45 are preferably formed separate from the stringers 40 and other portions of the base 20, but are fastened to the stringers 40 with fasteners 190.

The boards 45 include fastener holes 48 passing therethrough and base posts 49 extending from the top 46. The bottom edge 41 of the stringers 40 include a plurality of fastener bores 43 and post holes 44. The post holes 44 exhibit a complimental form to that exhibited by the base posts 49. Additionally, the base posts 49 are located on the top 46 of the boards 45 at locations corresponding to locations of the post holes 44 located on the bottom edge 41 of the stringers 40. Thus, the base posts 49 and post holes 44 allow for a consistent precise alignment of the boards 45 beneath the stringers 40 at a desired location.

Similarly, the fastener holes 48 formed in the boards 45 are located to align with the fastener bores 43 formed in the stringers 40. The fastener holes 48 are preferably substantially cylindrical holes with a slight bevel adjacent the bottom 47. The fastener bores 43 are preferably cylindrical blind bores extending vertically up from the bottom edge 41 and terminating before reaching the top edge 42 of the stringers 40. Both the fastener holes 48 and fastener bores 43 preferably exhibit a similar diameter.

Figure 16:
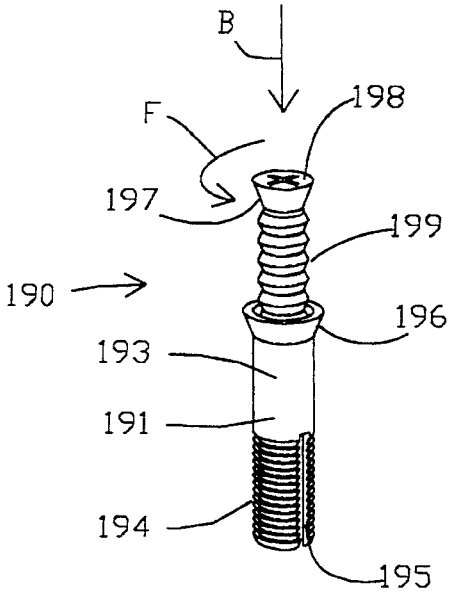
FIG. 16 is a perspective view of a fastener used to connect boards to a bottom edge of stringers forming a portion of the base.
Figure 17:
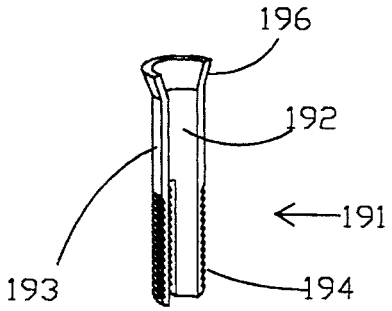
FIG. 17 is a sectional view of a portion of that which is shown in FIG. 16.

The fasteners 190, shown in detail in FIGS. 16 and 17, include a sleeve 191 and a screw 197. The sleeve 191 includes an interior 192 and an exterior 193. A portion of the exterior 193 includes teeth 194 which are biased to encourage insertion of the sleeve 191, but to resist removal of the sleeve 191 from the bore 43. The sleeve 191 includes slits 195 extending along sides thereof to allow deflection of the sleeve 191. The sleeve 191 includes a beveled head 195 corresponding to the bevel in the fastener hole 48. The interior 192 of the sleeve 191 is preferably smooth with no teeth therein. Preferably, the sleeve 191 is formed from a material which is of greater strength than a material from which the boards 45 and stringers 40 are formed. However, the screw 194 is preferably formed from a material which is stronger than the material from which the sleeve 191 is formed.

The screw 197 includes a head 198 at one end thereof and threads 199 extending therealong. The sleeve 191 is preferably configured to provide a slight interference fit within the hole 48 and the bore 43. In use of the fasteners 190, the screw 197 is only slightly inserted into the sleeve 191 and the sleeve 191 is then placed through the hole 48 and into the bore 43, along arrow A. A hammer or other linear force supplying device is then utilized to drive the screw 197 along arrow B and entirely into the sleeve 191. The threads 199 of the screw 197 then penetrate into the interior 192 of the sleeve 191 and also cause an exterior 193 of the sleeve 191 to be deflected and wedged securely into the bore 43. If removal of the fasteners 190 is required, a torque applying tool can be applied to the head 198 of the screw 197 and rotated about arrow F (FIG. 16) until the screw 197 is removed from the sleeve 191. The fasteners 190 thus connect the boards 45 to the stringers 40 to allow the base 20 to function in the manner desired.

With reference to FIGS. 1 through 6, details of the long sidewalls 50 of the container 10 are described in detail. Each long wall 50 is a substantially rigid planar rectangular construct including an inner surface 58 parallel to and spaced from an outer surface 59. The long wall 50 extends vertically between a lower edge 54 and an upper edge 52 substantially parallel to the lower edge 54. Two parallel side edges 56 extend from the lower edge 54 to the upper edge 52.

The outer surface 59 includes a plurality of horizontal ribs 60, vertical ribs 62 and peripheral ribs 64 extending therefrom. Preferably, the ribs 60, 62, 64 extend sufficiently from the outer surface 59 to increase a stiffness of the long sidewalls 50. The ribs 60, 62, 64 are preferably formed from similar material from which the long sidewalls 50 are formed and are integrally formed with the long sidewalls 50. However, the ribs 60, 62, 64 can alternatively be formed separately from the long sidewalls 50 and formed from differing materials having different characteristics.

The ribs 60, 62, 64 provide additional stiffness to the long sidewalls 50. This discourages substantial horizontal bowing of the long sidewalls 50 away from the interior when hydrostatic forces are applied to the inner surface 58 of the long sidewalls 50 by fluids or other materials contained within the container 10. By utilizing the ribs 60, 62, 64, a total amount of material required within the long sidewalls 50 is kept to a minimum, thereby decreasing a cost and weight of the long sidewalls 50 and hence the entire container 10.

In one form of the invention, the long sidewalls 50 can be additionally lightened by making the ribs 60, 62, 64 hollow. Voids 65 (FIG. 6) can be formed in the ribs 60, 62, 64 extending longitudinally therein In another form of the invention, the strength enhancement effect of the ribs 60, 62, 64 can be further increased by adding strengthening materials to a primary material forming the container 10. The strengthening materials provide one form of a means to stiffen and reduce deflection of the sidewalls 50. For instance, if the container 10 is formed primarily from a long chain hydrocarbon material, such as polypropylene, a strengthening material such as glass fiber, aramid fiber, carbon fiber or other strengthening materials, which exhibit longer microscopic lengths than that exhibited by the polypropylene or other primary material, can be added thereto. The strengthening material can be concentrated in regions of the container 10, such as within the voids 65, or can be homogenously added to the polypropylene and formed into a solid geometry along with the polypropylene or other primary material, such as by injection molding. The mold would exhibit a contour which would form parts of the container 10 with the precise geometries required.

The lower edge 54 of each long sidewall 50 includes a tongue 70 extending substantially downward therefrom. The tongue 70 (FIGS. 4 through 6) includes an inside surface 72 spaced a constant distance from an outside surface 74. A tip 78 defines an extremity of the tongue 70 extending between the inside 72 and the outside 74. An overhang 76 extends from the outside 74 to the outer surface 59 of the long wall 50.

The inside 72 and outside 74 preferably curve about a common central axis such that the tongue 72 exhibits a radius of curvature similar to a radius of curvature exhibited by the long groove 30 of the base 20. Additionally, the inside 72 and outside 74 can be configured to diverge slightly from true parallel as they extend away from the top 78. This divergence allows the tongue 70 to conform to any divergence between the first wall 31 and second wall 32 of the long grooves 30.

When one of the long sidewalls 50 is to be connected to the base 20, the long wall 50 is oriented with the tongue 70 extending down and the long sidewall 50 oriented slightly angled away from an interior of the container 10. The long sidewall 50 is then lowered toward the base 20 and rotated, along arrow C, until the tongue 72 rotates into the long groove 30. The long sidewalls 50 are rotated, along arrow C, until the long sidewall 50 is oriented substantially perpendicular to the floor 22 of the base 20. Once in this position, the long sidewalls 50 cannot be displaced along a line perpendicular to the floor 22 of the base 20. Rather, to remove the long sidewalls 50 from the base 20, the long sidewalls 50 must be pivoted outward away from an interior of the container 10. The J-joints 80 and F-joints 130 resist this outward pivoting of the long sidewalls 50 as is discussed in detail below.

Each of the two sides edges 56 of each long wall 50 includes one of the J-joints 80 thereon. Each J-joint (FIGS. 9 and 10) is preferably formed integrally with the long wall 50 so that no additional assembly is required in connecting the J-joints 80 to the long sidewalls 50. Each J-joint 80 includes a long leg 82 coextensive with the long sidewall 50. A bottom leg 84 extends from a tip of the long leg 82 adjacent the side edge 56 and in a direction closer to the inner surface 58 than to the outer surface 59, and preferably substantially perpendicularly away from the long leg 82. A short leg 87 extends from an end of the bottom leg 84 distant from the long leg 82. The short leg 87 preferably is substantially parallel to the long leg 82 and spaced from the long leg 82 by a distance similar to a length of the bottom leg 84.

The short leg 87 is oriented on a side of the long wall 50 adjacent the inner surface 58. Thus, the inner surface 58 of the long wall 50 transitions into an interior side 85 of the bottom leg 84 and then into an inner side 88 of the short leg 87. The outer surface 59 transitions into the exterior side 86 of the bottom leg 84 and then into the outer side 89 of the short leg 87. The long leg 82, bottom leg 84 and short leg 87 thus exhibit a "J"-shaped appearance.

A hump 90 is located extending from the inner surface 58 adjacent each of the side edges 56, but spaced slightly away from the bottom legs 84. The humps 90 assist in holding the F-joints 130 of the short sidewalls 100 adjacent the J-joints 80 of the long sidewalls 50 during assembly, as will be described below. The J-joint 80 utilizes the bottom leg 84 to prevent the short sidewall 100 from pivoting away from an interior of the container 10 and utilizes the short leg 87 to hold the long wall 50 adjacent the short wall 100. Thus, the J-joint 80 cooperates with the F-joint 130 to hold the long sidewalls 50 and short sidewalls 100 together without additional accessories connected thereto.

With reference now to FIGS. 1 through 4 and 7 and 8, details of the short sidewalls 100 are described in detail. In many respects, the short sidewalls 100 are similar to the long sidewalls 50. The short sidewalls 100 are thus substantially planar rigid constructs having an interior surface 108 and an exterior surface 109 parallel to and spaced from the interior surface 108. The short walls include a high edge 102 parallel to and spaced from a low edge 104, and two lateral edges 106 extending between the high edges 102 and low edges 104. A tab 120 extends from the low edge 104 to allow connection into the short groove 35 of the base 20. The exterior surface 109 includes a plurality of stiffeners, including horizontal stiffeners 110, vertical stiffeners 112, and peripheral stiffeners 114 similar to the ribs 62, 60, 64 of the long sidewalls 50. These stiffeners 110, 112, 114 function in a manner similar to the ribs 60, 62, 64 of the long sidewalls 50.

The tab 120 of each short sidewall 100 includes an inner slope 122 spaced a substantially constant distance from an outer slope 124. A bottom 126 extends between the inner slope 122 and the outer slope 124 at an extremity of the tab 120. The tab 120 includes ends 128 which are in-board from the lateral edges 106 of the short sidewalls 100. Thus, the tabs 120 exhibit a length similar to a length of the short grooves 35 of the base 20. The inner slope 122 and outer slope 124 are preferably spaced from each other by a distance similar to a distance between the inside wall 36 and the outside wall 37 of each short groove 35. Preferably, both the inner slope 122 and outer slope 124 exhibit curved surfaces which curve about a common central axis on a side of the short grooves 35 closest to the inside wall 36 of the short groove 35. The inner slope 122 and outer slope 124 can diverge slightly as they extend away from the bottom 126 to correspond with any divergence between the inside wall 36 and the outside wall of the short groove 35.

Thus, the short sidewalls 100 can connect to the base 20 in a manner similar to the connection of the long sidewalls 50. Essentially, the short sidewalls 100 are presented above the floor 22 of the base 20 and pivoted slightly away from vertical so that high edges 102 of the two short sidewalls 100 are closer to an interior of the container 10 than are the low edges 104. The short sidewalls 100 are then lowered toward the base 20 and pivoted, about arrow D, allowing the tabs 120 to rotate into the short grooves 35.

The short sidewalls 100 are pivoted until they are in a substantially perpendicular orientation with respect to the floor 22 of the base 20. Once in this vertical orientation, the short sidewalls 100 are prevented from translating in a direction perpendicular to the floor 22 of the base 20. To remove the short sidewalls 100 from the base 20, the short sidewalls 100 can be pivoted toward an interior of the container 10 and separated from the base 20. Note however, that when articles are stored within the container 10, hydrostatic forces exerted by the items within the container 10 prevent such rotation of the short sidewalls 100, thus maintaining the short sidewalls 100 attached to the base 20.

Figure 10:
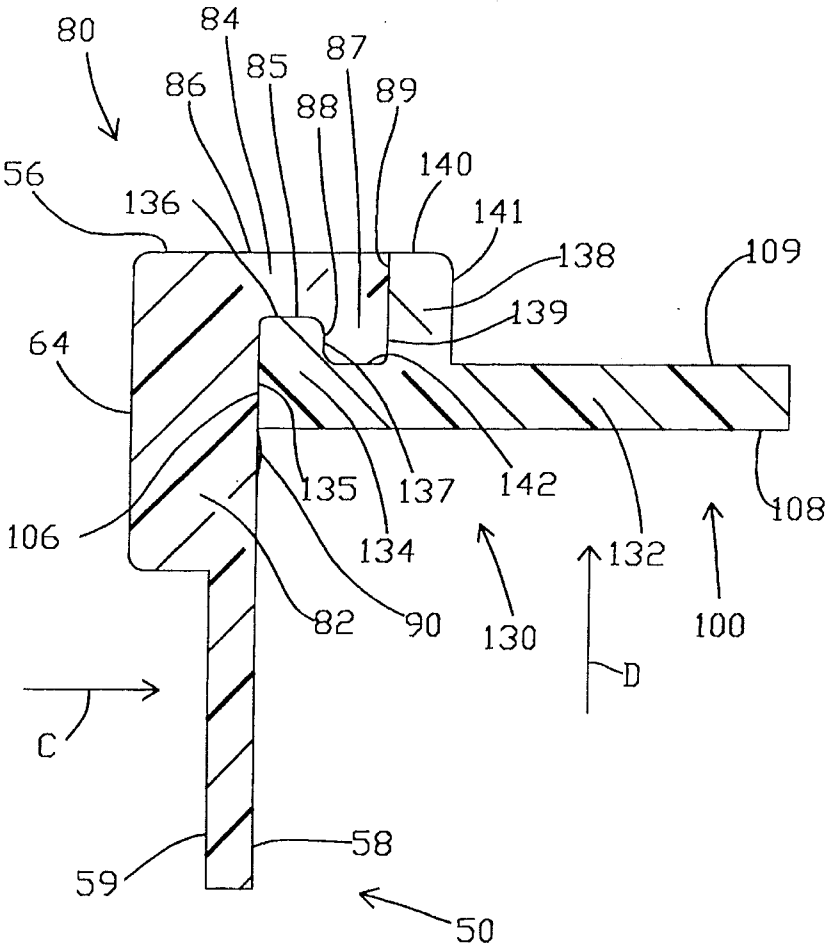
FIG. 10 is a sectional view taken along line 10—10 of FIG. 1 with separate parts exploded apart.
Figure 9:
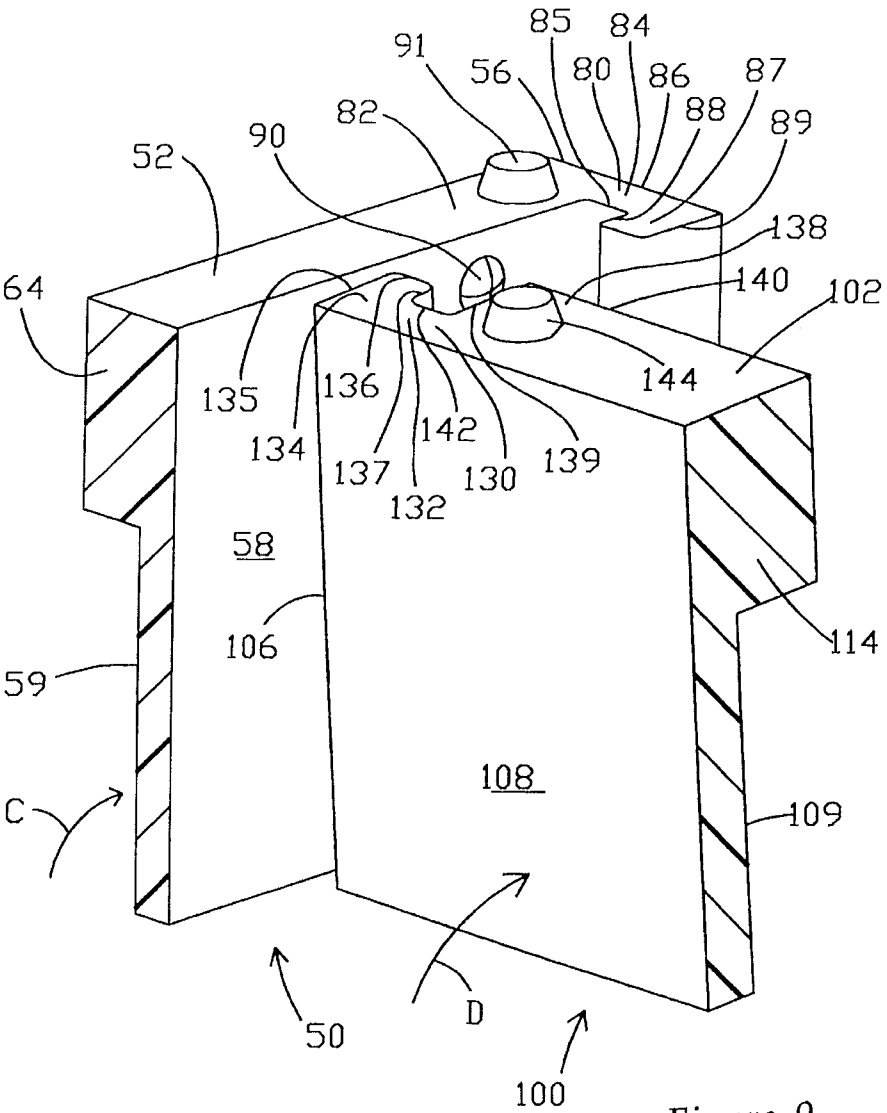
FIG. 9 is a perspective view of a corner joint between adjacent sidewalls of this invention shown at an upper edge of these sidewalls.

With reference to FIGS. 9 and 10, details of the F-joint 130 of the short sidewalls 100 are described. Preferably, two F-joints 130 are located on each short wall 100 with one F-joint 130 adjacent each lateral edge 106 of the short wall 100. The F-joint 130 includes a main leg 132, a top leg 134 and a middle leg 138. The main leg 132 is substantially co-extensive with the short wall 100 and extends to the lateral edge 106 of the short wall 100. The top leg 134 extends perpendicularly from the main leg 132 at the lateral edge 106 in a direction further from the interior surface 108 of the short wall 100 than from the exterior surface 109. The middle leg 138 is preferably substantially parallel to the top leg 134 and spaced inboard from the lateral edge 136 of the short wall 100 than from the exterior surface 109. The middle leg 138 extends substantially perpendicularly from the exterior surface 109 and in a direction further from the interior surface 108 than from the exterior surface 109.

Thus, the interior surface 108 extends to the lateral edge 106 and then transitions into a top side 135 of the top leg 134, then into an end side 136 of the top leg 134, then into a bottom side 137 of the top leg 134, then into a crotch 142 substantially parallel to the interior surface 108, then into an upper side 139 of the middle leg 138, then into an extremity 140 of the middle leg 138, then into a lower side 141 of the middle leg 138, then into the exterior surface 109 of the short wall 100.

Preferably, the top leg 134 has a width similar to a length of the bottom leg 84 of the J-joint. Thus, the top leg 134 can be nested between the long leg 82 and short leg 87 of the J-joint 80, causing the top leg 134 of the F-joint to be held adjacent the J-joint 80. In this configuration, the F-joint 130 is prevented from lateral movement away from an interior of the container 10 and prevents lateral movement of the J-joint 80 away from the interior of the container 10. The top leg 134 preferably has a length equal to a distance between the bottom leg 84 and the hump 90, such that the hump 90 can support the F-joint 130 adjacent the J-joint 80.

The F-joint 130 includes a bevel 131 (FIG. 4) adjacent each low edge 104 of each short wall 100. These bevels 131 in each F-joint 130 of each short wall 100 provide clearance for the J-joint 80 during initial erection of the sidewalls 50, 100 of the container 10. When the F-joint 130 and J-joint 80 are connected together, the top side 135 of the top leg 134 is oriented adjacent the inner surface 58, the end side 136 of the top leg 134 is adjacent the interior side 85 of the bottom leg 84, the bottom side 137 of the top leg 134 is adjacent the inner side 88 of the short leg 87, the crotch 142 is adjacent an end of the short leg 87, the upper side 139 of the middle leg 138 is adjacent the outer side 89 of the short leg 87, the extremity 140 of the middle leg 138 is substantially coextensive with the exterior side 86 of the bottom leg 84, and the lower side 141 of the middle leg 138 is spaced from the J-joint 80.

The J-joint 80 and F-joint 130 thus prevent the adjacent joint 80, 130 and attached sidewall 50, 100 from pivoting outward away from the interior of the container 10. The F-joint 130 additionally prevents the long sidewalls 50 from pivoting toward the interior of the container 100 and the humps 90 prevent the F-joints 130 and attached short sidewalls 100 from moving toward an interior of the container 100. The hump 90 is only configured to prevent F-joint 130 motion during erecting of the container 10. Hydrostatic forces exerted by materials within the interior provide significant additional force on the sidewalls 50, 100 preventing the sidewalls 50, 100 from pivoting toward the interior of the container 10. Additionally, when empty, the short sidewalls 100 are prevented from pivoting toward an interior of the container 10 by portions of the lid 150 discussed below.

With reference now to FIGS. 1 through 3 and 11 through 13, details of the lid 150 are described in detail. The lid 150 is preferably a substantially planar rigid unitary construct including a top wall 152 parallel to and spaced from a bottom wall 154. The lid 150 includes long edges 156 on opposite sides thereof and short edges 158 on opposite sides thereof extending between the long edges 156.

The bottom wall 154 of the lid 150 includes a peripheral stop 160 extending downward therefrom adjacent the long edges 156 and short edges 158, but spaced therefrom by a distance similar to a thickness of the long sidewalls 50 and short sidewalls 100. The peripheral stop 160 thus prevents high edges 102 of the short sidewalls 100 and upper edges 52 of the long sidewalls 50 from pivoting toward an interior of the container 10, especially when the container 10 is erected but not filled.

Between the peripheral stop 160 and the long edges 156 and between the peripheral stop 160 and the short edges 158 are a plurality of recesses 157 extending up into the bottom wall 154. High edges 102 of the short sidewalls 100 include short wall posts 144 extending upward therefrom. Upper edges 52 of the long sidewalls 50 include long wall posts 91 extending upward therefrom. Preferably, both the short wall posts 144 and long wall posts 91 exhibit a similar contour which mirrors that of the recesses 157. Additionally, the recesses 157 are located to correspond to locations of the short wall posts 144 and long wall posts 91. Thus, the long wall posts 91, short wall posts 144 and recesses 157 provide exact alignment of the lid 150 upon the sidewalls 50, 100 of the container 10.

The clips 180 secure the lid 150 to the sidewalls 50, 100. The top wall 152 of the lid 150 includes preferably twelve clip troughs 164 which extend thereinto along a line slightly angled from vertical with an upper portion thereof closer to a geometric center of the lid 150 than a lower portion thereof. A clip channel 162 extends from the clip troughs 164 toward the adjacent long edge 156 or short edge 158 and down to the bottom wall 154. These clip channels 162 are continued within the sidewalls 50, 150 as either clip notches 66 in the long walls 50 or clip grooves 116 in the short sidewalls 100. The clip troughs 164, clip grooves 116, and clip notches 66 have a width similar to a width of the clips 180. The clip troughs 164 are spaced from the long edges 156 and short edges 158 by a distance similar to a length of a top 182 of the clips 180. The clip grooves 116 and clip notches 66 exhibit a length similar to a side 184 of the clips 180.

The top 182 includes an upper lip 186 extending downward therefrom and toward the side 184 slightly. A lower lip 188 extends from a lower portion of the side 184 inwardly and upwardly toward the top 182. A release tab 189 connects to an extremity of the lower lip 188. The clip grooves 116 and clip notches 66 curve upwards at a lowermost portion thereof in a manner complimental to the lower lip 188 of the clips 180.

Figure 12:
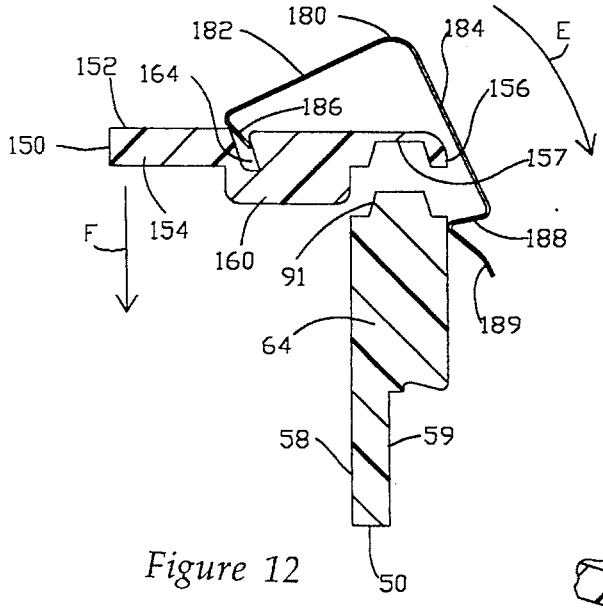
FIG. 12 is a full sectional view of that which is shown in FIG. 11 with the lid spaced from the sidewall and the clip beginning to lock the lid onto the sidewall.
Figure 13:
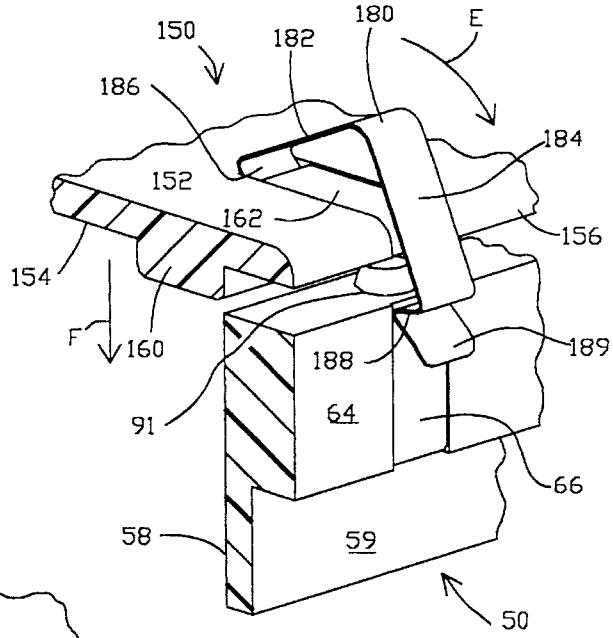
FIG. 13 is a perspective view of that which is shown in FIG. 12.
Figure 11:
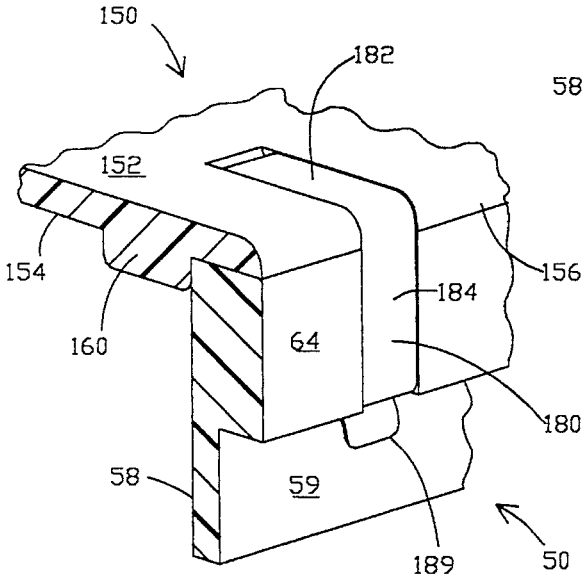
FIG. 11 is a perspective view of an interface between a sidewall and the lid with a clip connecting the lid to the sidewall.
Figure 14:
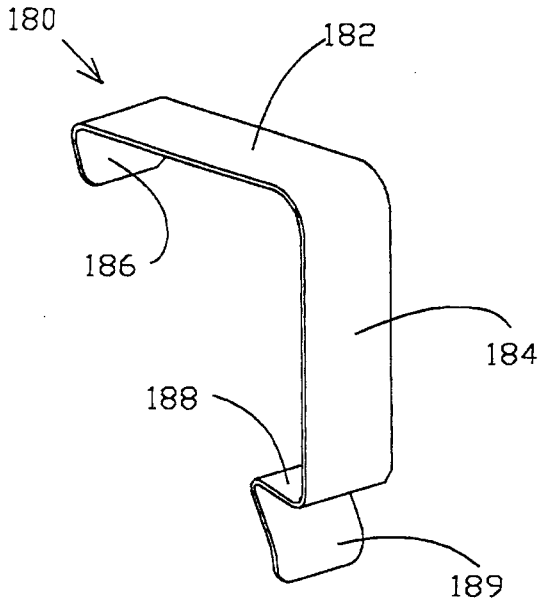
FIG. 14 is a perspective view of the clip which holds the lid to the sidewalls.
Figure 15:
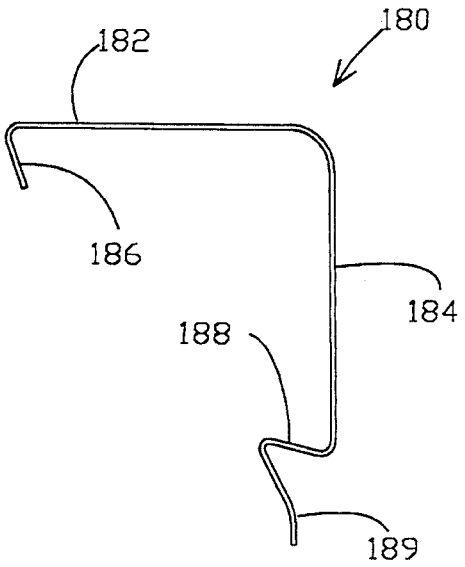
FIG. 15 is a side view of that which is shown in FIG. 14.

Preferably, three clip troughs 164, three clip channels 162 and three clip grooves 116 or clip notches 66 are provided at an inner face between each edge 156, 158 of the lid 160 and an adjacent wall 50, 100. Thus, a total of 12 clips 180 can be secured between the lid 150 and the adjacent wall 50, 100. As shown in FIG. 12, the clips 180 are initially located with the upper lip 186 extending into the clip trough 164 of the lid 150. The lid 150 is then held down tight against the wall 50, 100, along arrow F, and the clip 180 is rotated, about arrow E, with the upper lip 186 remaining within the clip trough 164 until the lower lip 188 extends below the lower end of the clip groove 116 or clip notch 66, defining a depression.

Preferably, the clips 180 are formed from a strong elastic material such as spring steel, such that the clips 180 can be deflected somewhat and yet when securely connected between the lid 150 and an adjacent wall 50, 100, can securely hold the lid 150 onto the adjacent wall 50, 100. To remove the clips 180, forces are applied to release tab 189 in an upward direction until the clip 180 can be rotated in a direction opposite that which is shown by arrow E.

Figure 18:
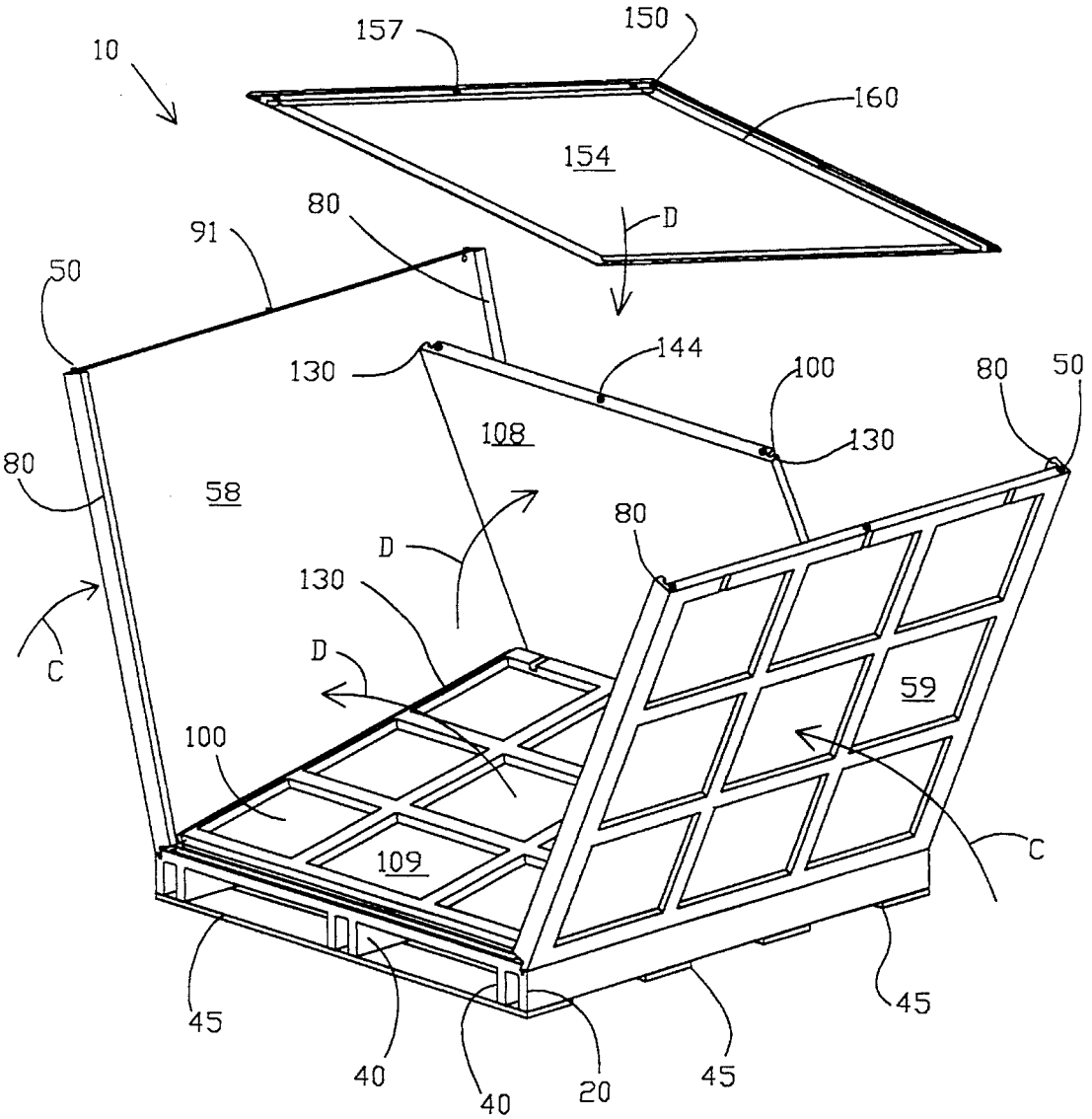
FIG. 18 is a perspective view of a portion of the container of this invention exhibiting the steps involved in erecting the container.

In use and operation, and as shown in FIG. 18, steps in erecting the container 10 are described in detail. Initially, base 20, boards 45, long sidewalls 50, short walls 100, and lid 150 are formed as individual structures. Preferably, this forming process is facilitated through the use of injection molding and each of the individual parts is provided in mass quantities from a common long-chain hydrocarbon material such as polypropylene. Because each of the boards 45 are identical, each of the long sidewalls 50 are identical, and each of the short sidewalls 100 are identical, only five separate types of items need be constructed.

Once construction of the individual parts is complete, the boards 45 are connected to the base 20. As discussed above, the fasteners 190 are utilized to securely attach the boards 45 to the base 20. The base 20 is then preferably laid upon a flat horizontal surface. Short sidewalls 100 can then be placed upon the base 20 with the tabs 120 thereof resting within the short grooves 35 and the short sidewalls 100 pivoting in toward an interior of the container 10. The two long sidewalls 50 are then oriented with tongues 70 thereof within the long grooves 30 of the base 20. The long sidewalls 50 are slightly angled initially and then rotated, along arrow C, until the long sidewalls 50 are oriented vertically extending up from the base 20 with the tongues 70 located within the long grooves 30.

The short sidewalls 100 are then pivoted, about arrow D, until the short sidewalls 100 are substantially vertical. The F-joints 130 are simultaneously slid into locking contact with the J-joints 80 until the F-joints 130 pass the humps 90 and are held in place vertically adjacent the J-joints 80. Alternatively, the long sidewalls 50 can be placed on the base 20 initially and rotated to vertical, and then the short sidewalls 100 can be placed on the base 20 and rotated to vertical. The container 10 is now in a configuration which allows for filling of the container 10 with material. Either a filled bag of fluid or other items can be located into the container or an empty bag can be located within the container 10 and then filled with fluent material.

The lid 150 is then oriented overlying the sidewalls 50, 100 with the peripheral stop 160 keeping the sidewalls 100 from pivoting in toward an interior of the container. The clips 180 are then utilized to secure the lid 150 to the sidewalls 50, 100. While the peripheral stop 160 of the lid 150 is primarily redundant when hydrostatic forces are exerted by items contained within the container 10, when the container 10 is being erected and is in an empty state, the peripheral stop 160 resists movement especially of the short sidewalls 100 toward the interior of the container 10. The container 10 can then be handled by various different lifting devices and appropriately placed for storage, transportation or other handling.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A container having an interior for supporting items within said interior thereof during transport, storage and handling, comprising in combination:

a base including a floor, a plurality of first sidewalls supported by said base and extending substantially perpendicular to said floor, each first sidewall including at least two side edges, a plurality of second sidewalls separate from said first sidewalls and supported by said base, said second sidewalls extending substantially perpendicular to said floor, each said second sidewall including at least two lateral edges, said base and said sidewalls defining an open-top interior, at least one of said side edges including means integrally formed with said first sidewalls to prevent movement of said first sidewalls away from said interior, and at least one of said lateral edges including means integral with said second sidewalls to prevent movement of said second sidewalls away from said interior, such that forces exerted upon said sidewalls by items stored within said interior are resisted by said first sidewall movement prevention means and said second sidewall movement prevention means, wherein said means to prevent movement of said sidewalls away from said interior includes a means to connect said side edges to said lateral edges, said connection means integrally formed in said side edges and said lateral edges, said connection means including a "J" shaped joint on one said edge and an "F" shaped joint on a connecting said edge.

2. The container of claim 1 further including means to locate said "J" shaped joint and "F" shaped joint together until said container is filled.

3. The container of claim 2 wherein said joint holding means includes a hump located on an interior surface of a sidewall having said "J" shaped joint and oriented to contact an interior edge of said sidewall having said "F" shaped joint.

4. The container of claim 2 wherein said base includes means to prevent perpendicular translation of said sidewalls away from said floor.

5. The container of claim 4 including a groove having a first wall and a second wall, said first and second walls having different yet substantially constant radii of curvature and curve about a common axis, said first and second walls spaced from each other a distance similar to a distance between an inside and an outside of a complementally formed tongue, such that said tongue and said sidewall attached thereto can pivot into said groove.

6. The container of claim 5 wherein said perpendicular translation prevention means includes at least one said groove formed in said base, a portion of said base adjacent said groove overlying a portion of said groove, and wherein at least one of said sidewalls includes a lower edge with said tongue extending from said lower edge, said tongue sized to pass into said groove with a portion of said tongue beneath a portion of said base, whereby said sidewall is precluded from perpendicular translation away from said floor of said base.

7. The container of claim 6 wherein at least one of said first sidewalls includes a first joint on at least one of said side edges, said first joint including a short leg spaced from said side edge by a bottom leg, wherein at least one of said second sidewalls includes a second joint thereon including a top leg extending from said lateral edge, said top leg having a width not greater than a distance between said short leg and said side edge of said first joint, whereby said top leg of said second joint of said second sidewall can fit between said short leg and said side edge of said first joint of said first sidewall and resist movement of said first sidewall away from said second sidewall.

8. The container of claim 7 including support means of said base having a plurality of stringers extending from a bottom surface on said floor and a plurality of boards attached to a bottom edge of said stringers, said boards having a long axis thereof oriented perpendicular to a long axis of said stringers.

9. The container of claim 8 further including a lid sized to overlie said first sidewalls and said second sidewalls when said first sidewalls and said second sidewalls are connected to said floor, said lid including means to prevent movement of said sidewalls toward said interior of said container.

10. The device of claim 9 wherein said lid includes a plurality of recesses extending up through a bottom wall of said lid, said recesses sized to receive posts extending from upper edges of said sidewalls, and wherein said means to resist motion of said sidewalls toward said interior includes a stop extending downward from said bottom wall of said lid, said lid including a plurality of troughs extending into a top wall of said lid, said troughs sized to receive an upper lip of a clip, said clip including a lower lip connectable to said sidewalls, such that said clips connect said lid to said sidewalls, preventing displacement of said lid away from said sidewalls.

11. The container of claim 10 wherein said sidewalls include stiffening ribs on a surface thereof opposite said interior, said stiffening ribs including means to reduce deflection of said sidewalls away from said interior.

12. The container of claim 1 wherein said container is formed of a long chain hydrocarbon material.

13. A collapsible industrial platform for supporting objects thereon and facilitating handling thereof, comprising in combination:

a substantially planar floor, means to support said floor above a surface at a sufficient elevation to allow a lifting device to be located beneath said floor, said floor having edges defining a perimeter of said floor, a plurality of separate sidewalls having tap edges, said sidewalls extending substantially perpendicularly from said floor and said top edges are substantially parallel to said floor, lid means contacting said top edges including interlocking means between said lid and said edges having a post contoured to nest within a complemental recess, a removable clip extending between an exterior surface of both said lid and said sidewall to hold together said lid and said sidewall, wherein said clip includes a lower lip and said release tab extends from said lower clip lip, said clip lip extending inwardly and below a depression formed on said sidewall so that said clip lies flush with said sidewall, and means integral with said sidewalls and said floor to secure said sidewalls to said floor.

14. The platform of claim 13 including a trough in said lid to locate one free end of said clip and a release tab at another free end of said clip.

15. The platform of claim 13 wherein said lid has a channel to receive said clip which lies flush with a top surface of said lid.

16. The platform of claim 15 wherein said securing means includes a means integral with said floor and one of said sidewalls to prevent perpendicular motion of said sidewall away from said floor.

17. The platform of claim 16 wherein said securing means includes a groove formed in said floor and a tongue extending from a lower edge of one of said sidewalls, said tongue configured such that when said sidewall is in position extending from said floor, a portion of said tongue underlies a portion of said floor, whereby vertical motion of said sidewall away from said top surface is prevented.

18. The platform of claim 17 wherein said sidewalls include side edges, each said side edge including a means to prevent translation of adjacent sidewalls away from said sidewalls.

19. The platform of claim 18 wherein each said side edge includes a means to connect to an adjacent said side edge.

20. The platform of claim 19 wherein said tongue of at least one of said sidewalls and said groove of said top surface are both curved such that said tongue can pivot into said groove, said tongue and said groove preventing linear translation of said tongue out of said groove.

21. The platform of claim 13 wherein said platform is formed of a long chain hydrocarbon material.

22. A method for erecting a collapsible palletized container from parts including a base, two first sidewalls and two second sidewalls, including the steps of:

providing the base with four edges, the base having a means to removably connect the sidewalls to the base at a location adjacent to the edges, providing the sidewalls with side edges, the side edges including means to couple to side edges of adjacent sidewalls, connecting two similar sidewalls to opposite sides of the base and extending up from the base, connecting a remaining two similar sidewalls to remaining opposite sides of the base and extending up from the base, and coupling the two first sidewalls to the two second sidewalls through the coupling means by means of preventing movement of said sidewalls including connecting one said side edge to an adjacent said side edge, and integrally forming in one said edge a "J" shaped joint and on another said edge an "F" shaped joint and locking the "J" shaped joint to the "F" shaped joint;

lid means contacting top edges of the sidewalls with a lid including locking a post contoured to nest within a complemental recess between the lid and the top edge, and clipping a removable lock clip between an exterior surface of both said lid and said sidewall to hold together said lid and said sidewall.

23. The method of claim 22 wherein said connecting step includes the steps of providing a lower edge of at least one of the sidewalls with a tongue and providing the base with a groove, the groove sized to receive the tongue, and pivoting the tongue into the groove.

24. The method of claim 23 wherein said pivoting step is repeated for all four sidewalls with two of the sidewalls pivoting in toward an interior of said container and two of the sidewalls pivoting out away from an interior of said container until all of the sidewalls are oriented substantially perpendicular to the base.

25. The method of claim 24 including the further steps of:

placing a lid onto upper edges of the sidewalls, fastening the lid to the sidewalls, and forming the container from a long chain hydrocarbon material exhibiting properties which allow injection thereof into a mold when in a molten state, the mold including contours therein which form the tongue and the groove integrally into certain of the parts.

26. The platform of claim 20 wherein there are two pairs of said curves of said tongues and of said grooves such that one pair curves in towards a center of said container, and another pair curves away from said container center.

27. The platform of claim 26 wherein said pairs are oriented in parallel registry at opposed sides of said container.

28. The platform of claim 27 wherein said one pair relies upon an "F" shaped joint on a connecting side edge.

29. The platform of claim 28 wherein said another pair relies upon a "J" shaped joint on a connecting side edge.

30. The platform of claim 29 wherein said one pair of tongue and groove connectors which curve towards said center of said container relies upon said "F" shaped connector on said side edges, and said another pair of tongue and groove connectors which curve away from said center relies upon said "J" shaped connectors on said side edges, said "J" shaped connector having a short leg (87) which resides within a crotch (142) of said "F" shaped connector while a top leg (134) of said "F" shaped connector resides within an interior side (85) formed in a bottom leg (84) adjacent said short leg (87) of said "J" shaped connector providing a locking fit, and a hump is located on an interior surface of a sidewall having said "J" shaped connector, said hump oriented to contact an interior edge of said sidewall having said "F" shaped joint.

* * * * *